US007431155B2

(12) United States Patent
Kadoya

(10) Patent No.: US 7,431,155 B2
(45) Date of Patent: Oct. 7, 2008

(54) CADDIE BAG WITH OUTWARDLY INCLINED DIVIDERS

(75) Inventor: Mamiko Kadoya, Hyogo (JP)

(73) Assignee: SRI Sports Limited, Kobe (JP)

( * ) Notice: Subject to any disclaimer, the term of this patent is extended or adjusted under 35 U.S.C. 154(b) by 544 days.

(21) Appl. No.: 10/875,236

(22) Filed: Jun. 25, 2004

(65) Prior Publication Data

US 2005/0115851 A1 Jun. 2, 2005

(30) Foreign Application Priority Data

Nov. 27, 2003 (JP) ..... 2003-396668

(51) Int. Cl.
*A63B 55/00* (2006.01)

(52) U.S. Cl. ..... 206/315.6; 206/315.3; 211/70.2

(58) Field of Classification Search ..... 206/315.3, 206/315.6, 315.2, 315.5, 315.7, 315.8; D3/318, D3/320; 280/DIG. 6; 211/70.2; 248/96; 106/315.3, 315.6
See application file for complete search history.

(56) References Cited

U.S. PATENT DOCUMENTS 5,125,507 A * 6/1992 Graziano, Jr. ..... 206/315.6
5,450,955 A * 9/1995 Olson ..... 206/315.6
5,518,113 A * 5/1996 Boone ..... 206/315.6
5,816,398 A * 10/1998 Wang ..... 206/315.6
5,871,093 A * 2/1999 Sutter ..... 206/315.6
5,915,320 A * 6/1999 Wang ..... 112/475.08
D412,789 S * 8/1999 Suk ..... D3/320
6,021,895 A * 2/2000 Wu ..... 206/315.3
6,047,822 A * 4/2000 Batten ..... 206/315.6
6,427,835 B1 * 8/2002 Chang ..... 206/315.6
6,652,045 B1 * 11/2003 Jungkind ..... 206/315.7
2002/0096444 A1 * 7/2002 Chang ..... 206/315.6
2004/0074792 A1 * 4/2004 Pratt et al. ..... 206/315.6
2004/0089569 A1 * 5/2004 Chang ..... 206/315.4

FOREIGN PATENT DOCUMENTS

JP 3042504 U 8/1997
JP 2003-102888 A 4/2003

* cited by examiner

*Primary Examiner*—Sue A Weaver
(74) *Attorney, Agent, or Firm*—Birch, Stewart, Kolasch & Birch,LLP

(57) ABSTRACT

A caddie bag comprises a plurality of division plates provided within an opening frame inward fitted to an upper end opening of a body of the caddie bag, wherein the division plates are provided with right slope plates which are inclined to a lower right toward a back face side in accordance with extending in a rightward direction toward the back face side and left slope plates which are inclined to a lower left toward a back face side in accordance with extending in a leftward direction, outer ends of the right and left slope plates are connected to right and left side frames of the opening frames, and each of sectioned spaces divided by said right and left slope plates.

14 Claims, 12 Drawing Sheets

PRIOR ART

Conventional Art

CADDIE BAG WITH OUTWARDLY INCLINED DIVIDERS

This Nonprovisional application claims priority under 35 U.S.C. § 119 (a) on Patent Application No(s). 2003-396668 filed in Japan on Nov. 27, 2003, the entire contents of which are hereby incorporated by reference.

BACKGROUND OF THE INVENTION

1. Field of the Invention

The present invention relates to a caddie bag receiving a golf outfit, and more particularly to a structure obtained by improving a shape of a division plate within an opening frame which is inward fitted to an upper end opening of the caddie bag, thereby preventing received golf clubs from overlapping so as to make it easy to identify the number of the golf club and also make it easy to take out the golf club.

2. Description of the Prior Art

A caddie bag is normally structured, as shown in FIG. 10, such that receiving bags 2 and 3 for small golf things are mounted to an outer surface whole area in a back face side 1*b* and an outer surface lower portion in a front face side 1*c* of a tubular body 1 in an upper end opening forming a golf club receiving portion, and a shoulder belt 4 is mounted to the front face side 1*a*. An opening frame 6 structured such that a division plate 5 is mounted to an inner portion, as shown in FIGS. 11A to 11D is inward fitted to the upper end opening 1*c*, and the golf clubs are inserted through spaces A, B, C, . . . divided by the division plate 5. Heads of the golf clubs are protected by putting a cover 7 thereon after the golf clubs are received.

FIG. 11A shows a structure disclosed in Japanese Utility Model No. 3042504. In this structure, one division plate 5 in a lateral direction is mounted to a center portion of the opening frame 6.

In a simple structure shown in FIG. 11A, since the opening frame is divided largely into only two divided spaces A and B, it is impossible to control positions of the inserted golf clubs, and the golf clubs are lapped over each other, so that it is hard to sort the golf clubs.

In a golf course, the caddie bag is mounted on a cart 9 as shown in FIG. 12, and is rested against a frame 9*a* of the cart 9 in a state in which the back face side 1*b* in which the receiving bag 2 is provided all around the whole surface is directed downward (in a direction of an arrow Q in FIG. 12A), and the front face side 1*a* to which the shoulder belt 4 is mounted is directed upward (in a direction of an arrow P in FIG. 12A) (refer to Japanese Unexamined Patent Publication No. 2003-102888).

In this state, the opening frame 6 of the upper end opening 1*c* is inclined such that the front face side 1*a* is directed to an upper side, and the back face side 1*b* is directed to a lower side, and the golf clubs CS tend to get together to a lower center within each of the divided spaces A and B within the opening frame 6.

The division plate 5 within the opening frame 6 shown in FIG. 11*b* is constituted by a longitudinal division plate 5*a* connecting a lateral center position of the front face side 1*a* and a lateral center position of the back face side 1*b*, and a plurality of lateral division plates 5*b* orthogonal to the longitudinal division plate 5*a*, and symmetrical spaces A and B, C and D, E and F, and G and H are provided by the division plates 5*a* and 5*b*.

In the case of the structure shown in FIG. 11*b*, since an area in a center portion side is wider than that in a side surface side, particularly in both side spaces A and B, and G and H in the front face side and the back face side, the golf clubs tend to get together to a center, and when the caddie bag is rested against the cart obliquely as mentioned above, or carried by using the shoulder belt, the golf clubs tend to get together to the lower back face side. Further, in each of the spaces A to F, since the partition defining the lower position of each of the spaces extends in a lateral direction, the golf clubs are arranged so as to spread to a whole area including the center portion.

Even in the case of particular structures shown in FIGS. 11C and 11D, the golf clubs tend to get together to the center in a back face side space A, and the golf club inserted to a space B at a center position is positioned near a center of the opening frame.

As mentioned above, even if the division plate is mounted within the opening frame so as to provide the sectioned spaces, the inserted golf clubs tend to be positioned at the center position in the lateral direction and near the center of the opening frame. In the case that the golf clubs get together as mentioned above, the golf club to be used is hard to be taken out, and a visibility of the number of the golf club is deteriorated due to the overlapping of the golf clubs, so that there is a problem that the number of the golf club can not be identified at one view.

SUMMARY OF THE INVENTION

The present invention is made by taking the problems mentioned above into consideration, and an object of the present invention is to improve a visibility of a golf club in such a manner that the number of the golf club can be easily identified, by improving a division plate within an opening frame so as to prevent the golf clubs from getting together to a center portion and overlapping in the center portion within a space divided by the division plate, and to make it easy to take out the golf club from a body portion.

In order to achieve the object mentioned above, in accordance with the present invention, there is provided a caddie bag comprising:

a plurality of division plates provided within an opening frame inward fitted to an upper end opening of a body of the caddie bag, wherein the division plates are provided with right slope plates which are inclined to an obliquely lower right toward a back face side in accordance with extending in a rightward direction toward the back face side from a front face side, and left slope plates which are inclined to an obliquely lower left toward a back face side in accordance with extending in a leftward direction, outer ends of the right and left slope plates are connected to right and left side frames of the opening frames, and each of sectioned spaces divided by the right slope plates and the left slope plates is inclined to the back face side in an outer peripheral side connected to the right and left side edges in comparison with a center portion side thereof.

In this case, the leftward direction and the rightward direction are defined such that in the case of defining the front face side and the back face side respectively as an upper side and a lower side, at a time of viewing the opening frame from an upper side (an outer side) of the caddie bag, a left side is defined as the leftward direction, and a right side is defined as the rightward direction.

A shoulder belt is provided in an outer surface of an upper portion in a front face side of the body, golf outfit receiving bags are provided in an outer surface of a lower portion in the front face side and an outer surface in a back face side, and the golf bag is rested against a frame of a cart at a time of being mounted on the cart in a state in which the front face side is directed to the upper face and the back face side is directed to the lower face. Further, when the person carries the caddie bag by the shoulder belt, the golf bag is in an inclined state in which the front face side to which the shoulder belt is mounted is directed to the upper side and the back face side is directed to the lower side.

Since the division plate within the opening frame is inclined downward toward the back face side corresponding to the lower face side at a time when the caddie bag is mounted on the cart and the person carries the caddie bag, as mentioned above, each of spaces sectioned by the right slope plate and the left slope plate is inclined downward to the lower left and the lower right. Accordingly, the golf club inserted to each of the spaces is obliquely moved to the lower left and the lower right, and is in a state in which the golf clubs are dispersed to both the right and left sides, and it is possible to prevent the golf clubs from getting together in the center portion of the opening frame. In the case that an empty space in which no golf club exists is generated in the center portion side, it is easy to identify the number of the golf club through the empty space, and it is easy to take out the golf club by utilizing the empty space.

Further, since the inserted golf club obliquely moves to the lower left and the lower right at a time of inserting the golf club, the empty space for insertion is always generated in the center portion, and it is easy to insert the golf club.

It is preferable that an area of each of the sectioned spaces divided by the division plates within the opening frame is enlarged step by step toward both the right and left sides from the center portion side.

In the case that the area is enlarged toward both the right and left side portions as mentioned above, the inserted golf club can more easily move to both the right and left sides (the lower right and the lower left), and when a plurality of golf clubs are inserted to one space, the golf clubs moving to both the right and left sides are prevented from lapping over with each other.

Inner ends of the right and left slope plates are connected to the adjacent right and left slope plates, and the right slope plate and the left slope plate are alternately connected sequentially, or any one of the right and left slope plates is connected to a plurality of the other of the right and left slope plates at an interval.

In other words, the longitudinal center division plate connecting the back face side center to the front face side center shown in FIG. 11*b* is not provided within the opening frame, and the division plates are all constituted by the right slope plates and the left slope plates.

The connection between the right and left slope plates may be achieved by alternately connecting the right slope plates and the left slope plates sequentially, or may be achieved by connecting two left slope plates to the right slope plate at an interval.

In both cases, each of the spaces which are divided by the right and left slope plates and are inclined to the lower right and the lower left toward the back face side respectively is long in a lateral direction. Accordingly, it is possible to arrange a plurality of golf clubs in a dispersion manner from the outer peripheral side contact with the opening frame toward the center portion side sequentially.

In this case, in order to increase the number of the divided sections, a longitudinal division plate connected to the center position in the back face side may be mounted to the space of the back face side end, and a space divided in a lateral direction may be provided in the space of the back face side end.

It is preferable that a connection point of at least partial inner ends of the right slope plates and the left slope plates is shifted from a longitudinal center line connecting the back face side center and the front face side center, and a center portion side of the divided space is extended over a longitudinal center line from a left end or a right end.

In the case that the connection point of the inner end of the right and left slope plates is shifted from the longitudinal center line as mentioned above, it is possible to further increase the length of each of the divided spaces in the lateral direction.

At this time, since the golf clubs received in the divided spaces are dispersed to both the right and left sides and are shifted in the longitudinal direction, by shifting the positions at which the outer ends of the right slope plates and the left slope plates are connected to the opening frame, in the longitudinal direction, the center empty space is widened, so that it is possible to improve a visibility of the golf clubs, and it is easy to take out the golf clubs from the center empty space.

On the other hand, the inner ends of the right slope plates and the left slope plates may be connected to both faces of a longitudinal center plate connecting the back face side center and the front face side center, and the connection position may be displaced in an opposing direction or the longitudinal direction.

In the case that the caddie bag is large and the opening frame is large, a lateral area is first divided into two sections in a lateral direction by mounting the longitudinal center plate, and each of the right and left areas is divided in the longitudinal direction by mounting the slope division plates within each of the right and left areas. In this case, since each of the areas divided by the slope division plates is inclined downward toward the right and left side edges in the opening frame connection side, it is possible to arrange the golf clubs inserted to the respective divided spaces in both the right and left sides in a dispersion manner.

The right slope plate and the left slope plate are constituted by a linear slope plate or/and a curved slope plate.

In both of the linear slope plate and the curved slope plate, slope angles of the right slope plate and the left slope plate are set such that a slope angle a with respect to a lateral straight line orthogonal to a longitudinal center line connecting the back face side center to the front face side center is not less than 5 degree and not more than 45 degree.

In this case, the slope angle more than 0 degree is sufficient, however, it is possible to secure a dispersion property of the golf clubs to both the right and left sides by inclining at 5 degree or more. The slope angle is further preferably not less than 10 degree, not less than 15 degree and not less than 20 degree. On the other hand, if the slope angle is more than 45 degree, the area in the center portion side is narrow, so that it is hard to take out the golf club from the center side and insert the golf club to the center side. The slope angle not more than 35 degree is preferable, and the slope angle not more than 30 degree is most preferable.

In this case, the division plate provided within the opening frame is not limited to the lateral slope plate and the longitudinal center partition plate, and may be structured such that the circular arc plate connected to the opening frame in both ends is provided, one end of the slope plate is connected to the circular arc plate and another end thereof is connected to the opening frame.

In this case, the portion surrounded by the circular arc plate and the opening frame is formed as a small divided space, and the wood type golf club can be inserted therein.

It is preferable that three to seven division plates are provided, it is further preferable that four to six division plates are provided, it is preferable that the number of the spaces divided by the division plates is four to eight, and it is further preferable that the number is five to seven.

In the case that the number of the divided space is increased by increasing the number of the division plates, the area of each of the divided spaces is narrow, so that it is hard to take out the golf club and insert the golf club. On the other hand, in the case that each of the divided space is too wide by reducing the number of the division plates, the golf clubs tend to get gather in both the right and left side edges in each of the spaces. Accordingly, it is preferable to employ the ranges mentioned above.

The shape of the opening frame is not particularly limited, however, it is preferable that the shape employs an oval shape or an elliptic shape in which a longitudinal center line connecting the back face side center and the front face side center is a long axis, and a lateral center line connecting the right and left centers is a short axis. In this case, the shape may be a complete round shape or a rectangular shape.

The annular opening frame itself is wholly inclined downward in the longitudinal direction of the caddie bag from the front face side center corresponding to the upper face side toward the back face side center corresponding to the lower face side, at a time of being mounted on the cart or being carried by the shoulder belt, and an area of the opening frame is enlarged in comparison with the case that an upper end of the opening frame is set horizontal.

In detail, the opening frame is formed in a chevron shape from the front face side center toward the back face side center, the upper end center in the front face center is protruded to the upper side in the longitudinal direction of the caddie bag from the upper end of the back face center, and a distance from the front face side center to a chevron apex is made shorter than a distance from the chevron apex to the back face side center.

In accordance with the shape mentioned above, it is possible to make the downward slope surface of the opening frame which is inclined downward at a time of being mounted to the cart large, and it is possible to more smoothly take out the golf club. In addition, in accordance with the chevron shape, it is possible to average the directions of the golf clubs in a state of arranging the caddie bag vertically, and it is possible to stably hold the caddie bag with good balance.

The whole opening frame and the opening end side upper portion of the division plate are formed by a rigid member because it is necessary to support the golf club. In addition, the lower portion of the partition plate is formed by an elastic member.

In specific, the upper rigid member is formed by wrapping a rigid plate such as a resin plate or the like by a woven fabric having a cushion property, and the elastic member is formed by extending the woven fabric having the cushion property to the lower side. Further, the division plate is structured by protruding a hard frame from the thick center of the upper end surface, thereby improving a slip at a time of inserting the golf club.

A division cloth extending to the body bottom surface and having an improved slip property is continuously provided in the lower end of the division plate constituted by the elastic member, and a lower end of the division cloth is connected to a bottom board mounted on the body bottom surface.

Accordingly, the golf club inserted through each of the spaces divided by the division plates within the opening frame is sorted without being interfered with each other in the inner portion of the body. In addition, since the division cloth is continuously provided in the division plate, it is possible to prevent the golf club from catching on the division plate at a time of taking out the golf club so as to be hard to be taken out.

As mentioned above, in the caddie bag in accordance with the present invention, since the division plate in the inner portion of the opening frame forming the port for inserting and taking out the golf club is improved, the caddie bag is provided with the right slope plate and the left slope plate which are inclined in both the right and left sides toward the back face side corresponding to the lower face side in the case that the caddie bag is inclined at a time of being mounted on the cart or being carried by the person, and the respective divided spaces sectioned by the slope division plates are inclined to the lower right and the lower left, the golf clubs received in the respective divided sections move to the lower right and the lower left, and it is possible to prevent the golf clubs from getting together in the center portion.

As a result, the golf clubs do not overlap, and it is easy to identify the number of each of the golf clubs, whereby it is possible to improve a visibility. Further, it is possible to smoothly insert and take out the golf club by utilizing the center empty space at both of inserting time and taking out time.

BRIEF DESCRIPTION OF THE DRAWINGS

FIGS. 1A and 1B show a caddie bag in accordance with a first embodiment of the present invention, in which FIG. 1A is a perspective view as seen from a back face side, and FIG. 1B is a perspective view as seen from a front face side;

FIGS. 10A and 10B show a conventional caddie bag, in which FIG. 10A is a perspective view of a state in which a cover is put on, and FIG. 10B is a perspective view showing an opening frame and a division plate with taking away the cover;

BEST MODE FOR CARRYING OUT THE INVENTION

A description will be given below of an embodiment in accordance with the present invention with reference to the accompanying drawings.

FIGS. 1 to 6 show a first embodiment.

Figure 1A:
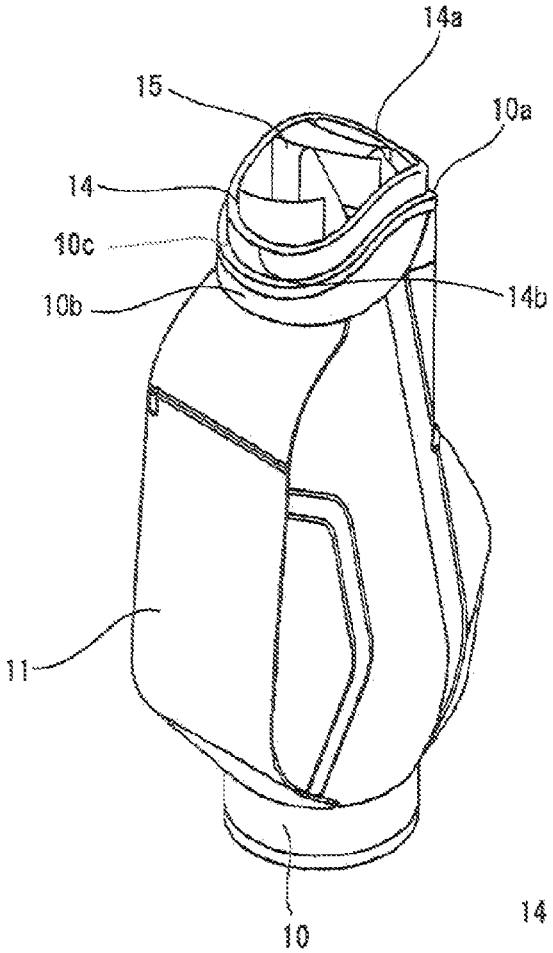
Figure 1B:
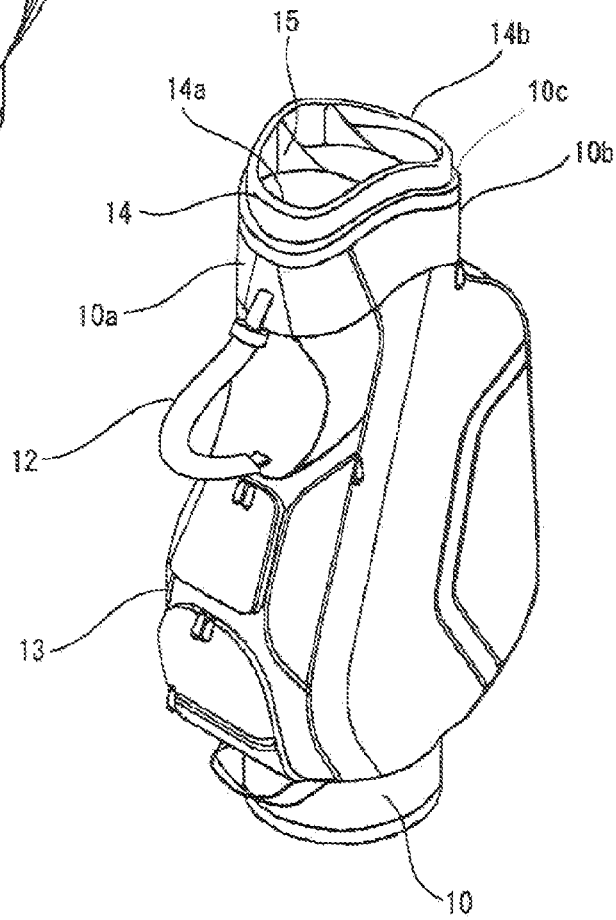

A caddie bag is not limited and is optional in an aspect of a golf outfit receiving bag which is provided in a body of the caddie bag and an outer surface of the body, and a mounting position of a shoulder belt. In the present embodiment, as shown in FIGS. 1A and 1B, one large receiving bag 11 is mounted to an outer surface in a back face side 10*b* of a body 10 formed in an oval shape in a horizontal cross section and constituted by a vertically long tubular body approximately all around the surface. A shoulder belt 12 is mounted to an upper portion of the outer surface of the front face side 10*a*, and a receiving bag 13 is mounted to a lower portion thereof.

An opening frame 14 in which a slope division plate 15 is mounted to an inner portion is inward fitted and fixed to an upper end opening 10*c* of the body 10. The upper end opening 10*a* of the body is formed in an oval shape in which a longitudinal center line L1 connecting a back face side center and a front face side center is a long axis, and is descended in a chevron shape from the back face side center toward the front face side center.

Figure 2A:
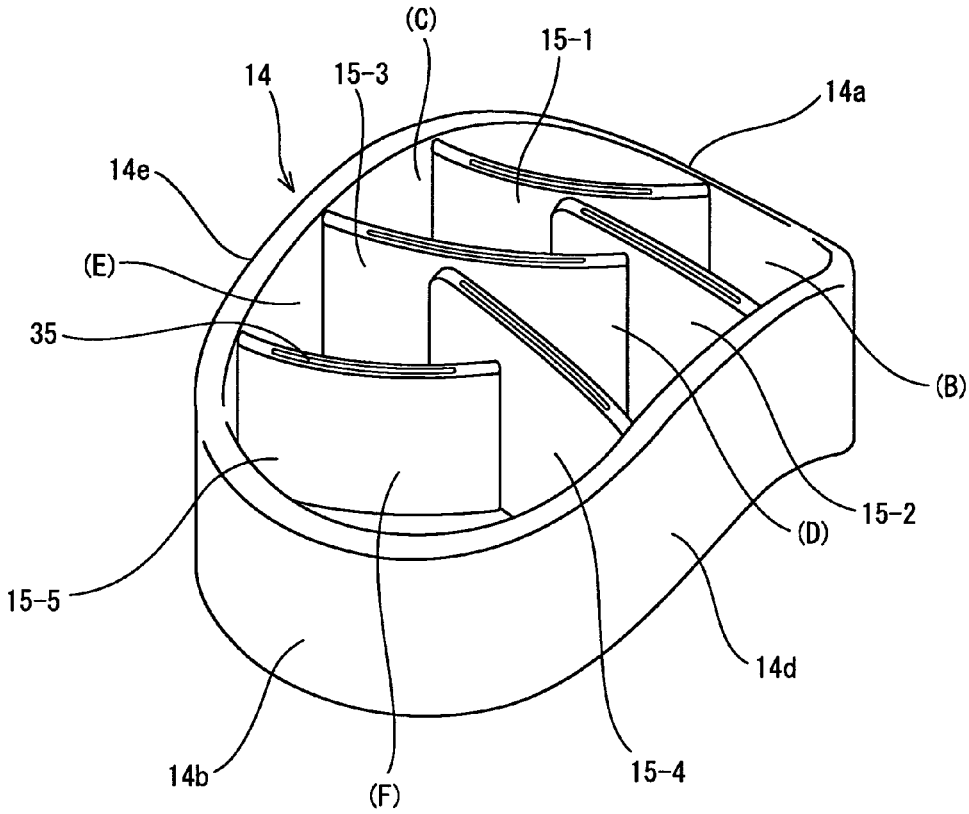
FIG. 2A is a perspective view showing an opening frame and a division plate in an inner portion of the opening frame.
Figure 2B:
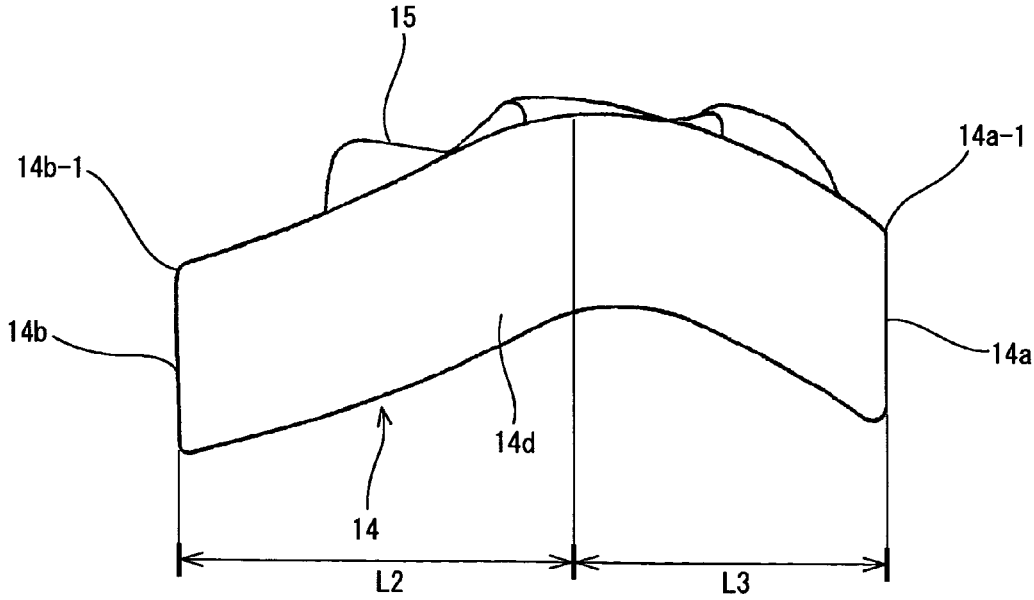
FIG. 2B is a side elevational view of FIG. 2A.

The opening frame 14 inward fitted to the opening 10*a* is formed in a similar shape to the opening 10*a*, and as shown in FIG. 2, the opening frame 14 is formed in a chevron shape from a center in a front face side 14*a* toward a center in a back face side 14*b* and an upper end 14*a*-1 of a lateral center in the front face side is protruded to an upper side from an upper end 14*b*-1 of a lateral center in the back face side. In addition, a distance L3 from the front face side center to the chevron apex is made shorter than a distance L2 from the chevron apex to the back face side center.

Figure 3A:
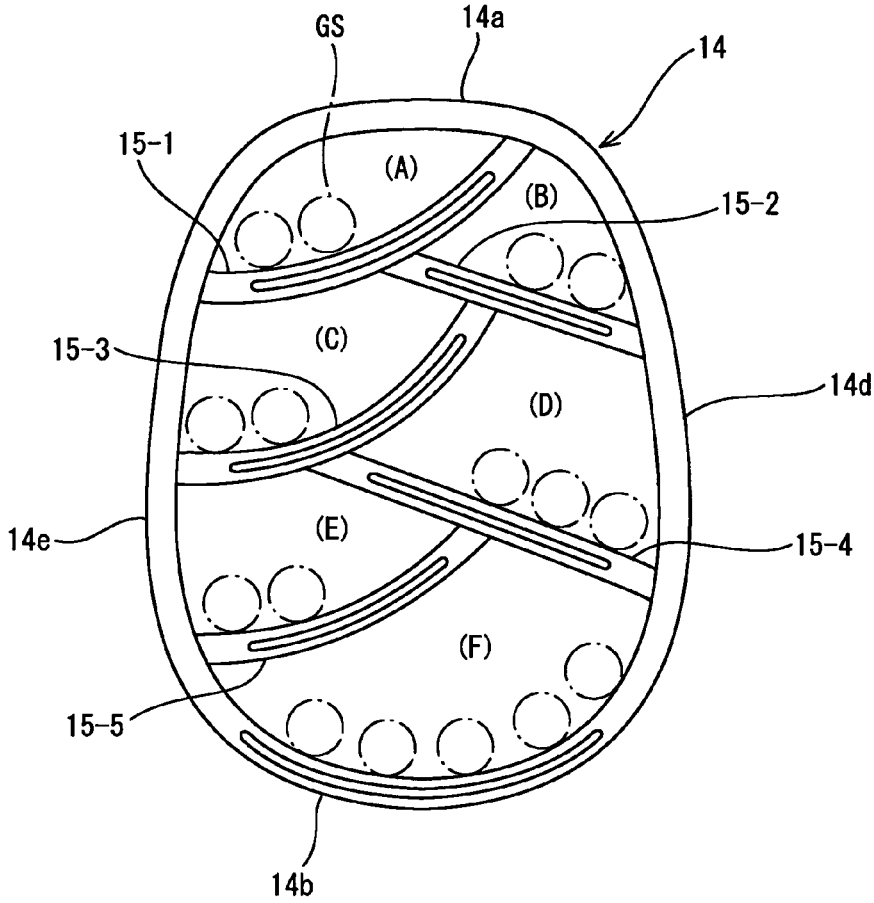
FIG. 3A is a plan view of FIG. 2A.
Figure 3B:
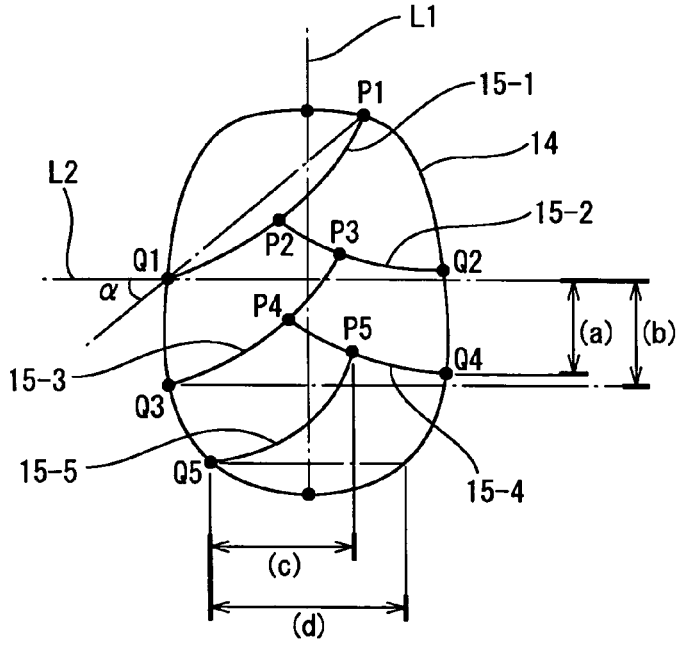
FIG. 3B is a schematic view showing a positional relation and a dimensional relation of slope plates.

As shown in FIG. 3, within the opening frame 14, there are provided with two right slope plates 15 which are inclined to the lower right from the front face side 14*a* toward the back face side 14*b*, and three left slope plates 15 which are inclined toward the lower left. An inner portion of the opening frame 14 is divided into five divided spaces A to F by continuously connecting the right and left slope plates alternately.

A first left slope plate 15-1, a first right slope plate 15-2, a second left slope plate 15-3, a second right slope plate 15-4, and a third left slope plate 15-5 are sequentially arranged from the front face side, and the first left slope plate 15-1 in the front face end side is connected to an inner peripheral surface of the opening frame 14 in both ends thereof. The first right slope plate 15-2 is connected to the right frame portion 14*d* of the opening frame 14 in an outer end and is connected to the first left slope plate 15-1 in an inner end. The second left slope plate 15-3, the second right slope plate 15-4 and the third left slope plate 15-5 are connected to the opening frame 14 in an outer end in the same manner. The second left slope plate 15-3 and the third left slope plate 15-5 are connected at their inner ends to the front faces of the first right slope plate 15-2 and the second right slope plate 15-4 respectively. The second right slope plate 15-4 is connected at its inner end to the front face side of the second left slope plate 15-3.

The connection positions P1 to P5 in the inner ends of the respective slope plates 15-1 to 15-5 are shifted laterally from the longitudinal center line L1, are close to the right from the longitudinal center line L1 in the left slope plates, and are close to the left from the longitudinal center line L1 in the right slope plates.

Further, the connection positions Q1 to Q5 between the outer ends of the respective slope plates 15-1 to 15-5 and the opening frame 15 are also shifted in the longitudinal direction.

In detail, on the assumption that an interval of the connection positions of the adjacent outer ends in the one side is (b), and an interval of the connection positions of the outer ends of the adjacent right and left slope plates is (a), (a)/(b) is set within a range between 0.1 and 0.9, and the position of the outer connection end in the lateral direction is shifted in the longitudinal direction. It is preferably set between 0.2 and 0.8, and most preferably set between 0.3 and 0.7. As mentioned above, in the case that the position is shifted in the longitudinal direction, it is possible to make the center space larger.

Further, with respect to the shift amount from the longitudinal center line L1, in the same slope plate, on the assumption that a dimension from the outer end connection position to the inner end connection position is (c), and a dimension from the outer connection position to the opposing opening frame is (d), (c)/(d) is larger than 0.5 and not more than 0.8. This is because the slope plates cross too much if the value is smaller than 0.5 and it is hard to take in and out the golf club. It is preferably set between 0.55 and 0.75, and most preferably set between 0.6 and 0.7.

In the slope plate 15, the left slope plates 15-1, 15-3 and 15-5 are inclined in a curved shape having a large curvature, and the right slope plates 15-2 and 15-4 are formed in a linear shape.

In both of the linear shape and the curved shape, in the slope angle of the right slope plates and the left slope (the slope angle of the line connecting the inner and outer connection points in the case of the curved shape), the slope angle $\alpha$ with respect to the lateral line L2 orthogonal to the longitudinal center line L1 is set not less than 5 degree and not more than 45 degree.

The slope angle is set such that an area is enlarged toward a right end edge in a slope direction from a center side, or toward a left end edge, in all of the sectioned spaces A to F.

Figure 4A:
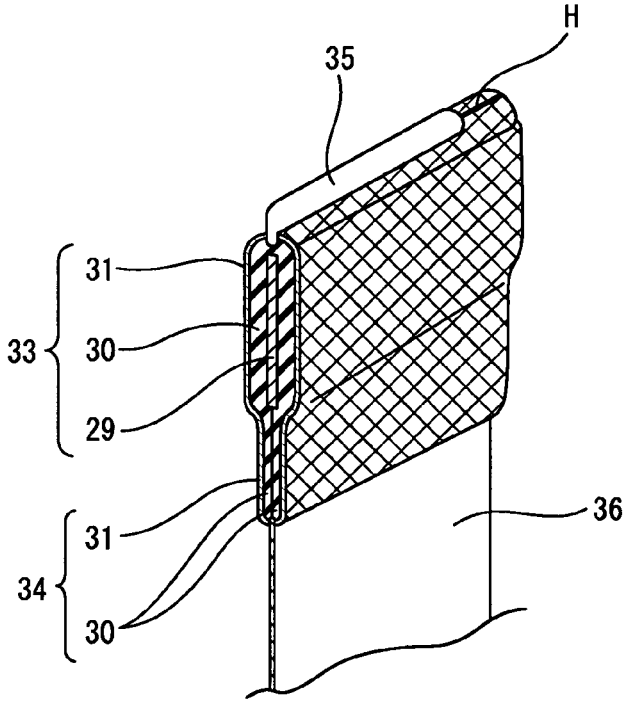
FIG. 4A is a broken perspective view of the slope plate forming the division plate.
Figure 4B:
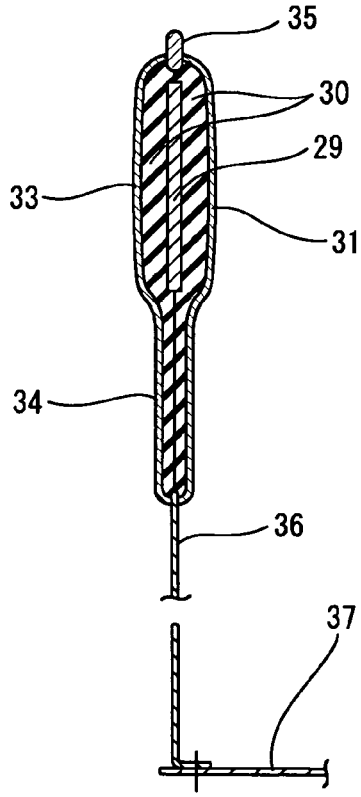
FIG. 4B is an enlarged cross sectional view.

An entire of the opening frame 14 and an opening end side upper portion of the right and left slope plate 15 forming the division plate are structured, as shown in FIG. 4, such that both faces of a resin plate 29 are wrapped by an urethane sheet 30 in which a woven fabric 31 is stuck to a front surface, an upper end surface is seamed (H), and a rigid member 33 is formed by attaching a cushion member to the front surface. A lower portion of the right and left slope plate 15 is formed as a cushion member 34 by laminating the urethane sheet 30 to which the woven fabric 31 is stuck. Further, a rigid plate 35 having a smooth surface is protruded from a center of an upper end surface of the rigid member 33 in the center of the upper end surface of the circular arc portion in the back face side of the opening frame 14 and the right and left slope plates 15, and a lower portion of the frame member 35 is inserted into the seamed portion of the urethane member 30.

Figure 5:
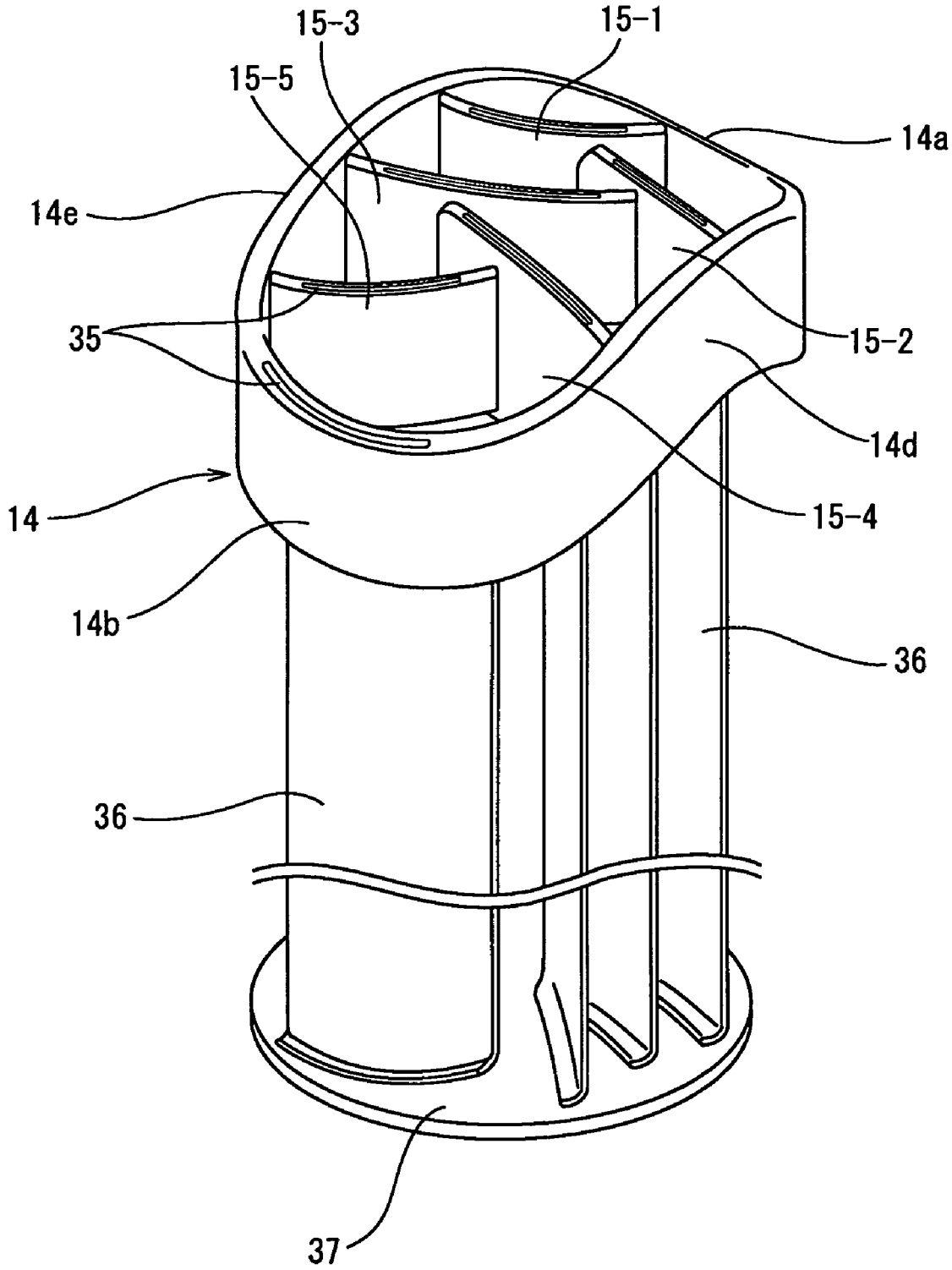
FIG. 5 is a perspective view showing a division cloth connected to the division plate.

Further, as shown in FIG. 5, a division cloth 36 extending to a bottom surface of the body is continuously mounted to the lower cushion member 30 of each of the slope plates 15, and a lower end of the division cloth 36 is connected to a bottom board 37 mounted on the bottom surface of the body.

Figure 6A:
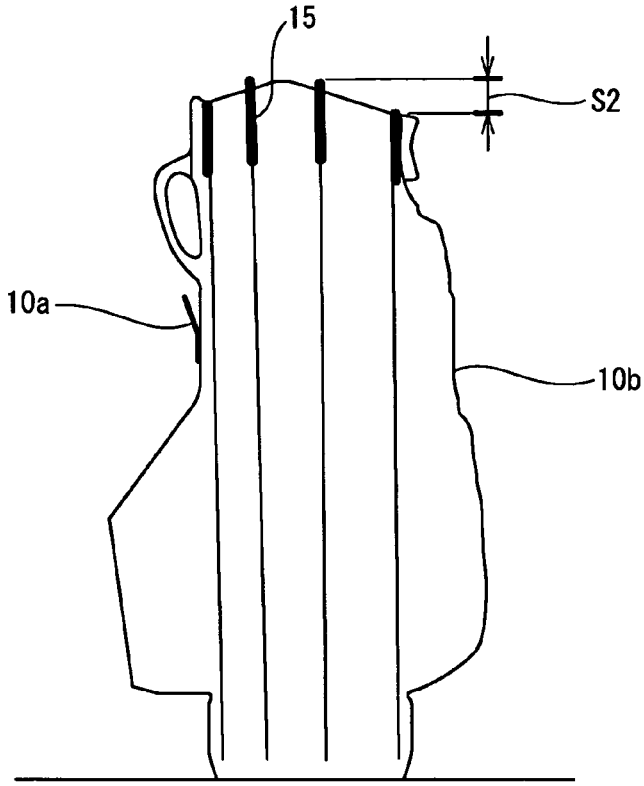
FIG. 6A is a schematic view showing a state in which the caddie bag shown in FIG. 1 is vertically arranged.
Figure 6B:
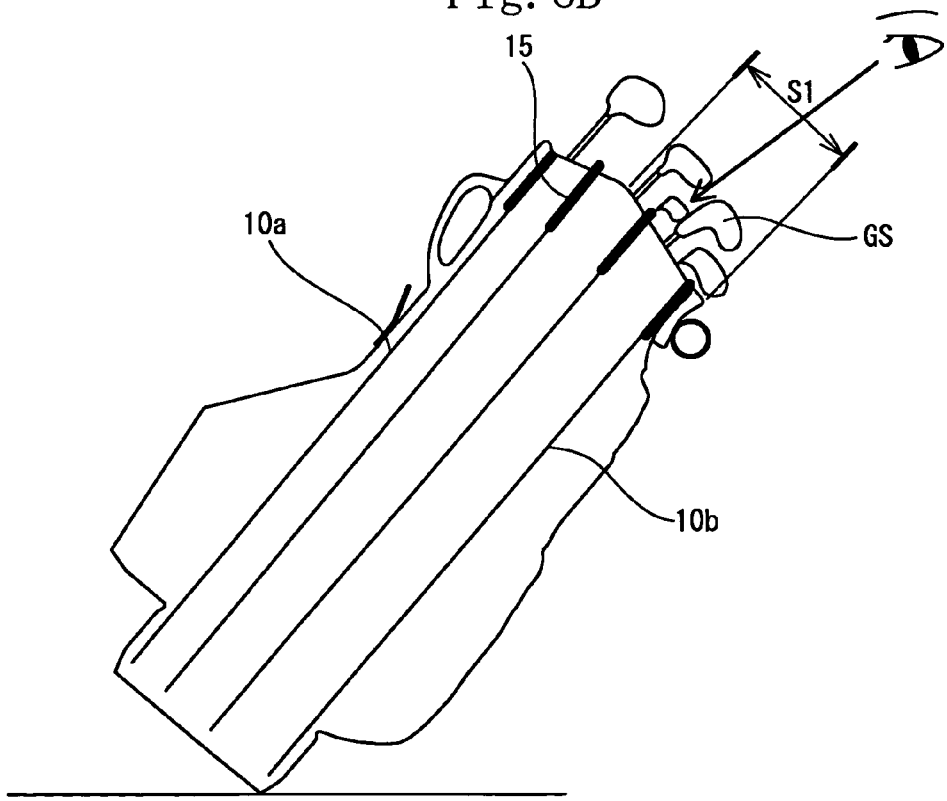
FIG. 6B is a schematic view showing a state in which the caddie bag is mounted on a cart so as to be inclined.

On the assumption of the caddie bag provided with the division plate constituted by the opening frame 14 and the right and left slope plates 15, in both of the case that the caddie bag is arranged vertically as shown in FIG. 6A and the case that the caddie bag is arranged obliquely at a time of being mounted on the cart as shown in FIG. 6B, each of the divided spaces A to F divided by the right and left slope plates 15 are inclined to the lower left or the lower right from the front face side 10*a* of the body 10 toward the back face side 10*b*, as shown in FIG. 3. Accordingly, the golf clubs GS inserted to the divided spaces A to F move to both sides of the lower left and the lower right in a dispersion manner, and do not get together in the center portion.

In particular, at a time of being mounted on the cart, in the case that the caddie bag is inclined in a state in which the back face side 10*b* is directed to the lower face and the front face side 10*a* is directed to the upper face, as shown in FIG. 6B, the golf clubs GS securely move to both of the lower left and the lower right in the respective divided spaces A to F which are inclined rightward and leftward toward the back face side due to their own weight, and an empty space (a gap) is formed in the center. Accordingly, the golf club GS to be taken out can be smoothly taken out by moving the golf club GS close to the center side corresponding to the empty space, and it is possible to identify the number.

Further, since the opening frame 14 is inclined such that the back face side is long, an inner area S1 of the opening frame visible from the golfer is expanded, it is possible to identify the number at one view, and it is possible to easily take out the golf club GS inserted to the divided space in the back face side. This means that the area S1 is expanded more than an area S2 visible by the golfer in the case that the caddie bag is vertically arranged as shown in FIG. 6A, and it is effective at a time when the caddie bag is mounted on the cart or is carried by the shoulder belt.

Further, since the golf clubs GS received in the respective divided spaces A to F get together in the downward inclined back face side at a time when the caddie bag is mounted on the cart, it is necessary to support the golf clubs GS by the upper surfaces (in the front face side) of the right and left slope plates 15 and the circular arc portion of the upper surface (in the front face side) of the lower end portion of the opening frame 14. On the contrary, since the upper portions of the opening frame 14 and the right and left slope plates 15 are formed by the rigid member, there is no problem in strength. In addition, since the hard plate 35 having a good slip property is provided in a protruding manner in the upper end surfaces of the opening frame 14 and the right and left slope plates 15, it is possible to smoothly insert the golf club along the hard plate at a time of inserting. Further, since the surfaces of the opening frame 14 and the right and left slope plates 15 are coated by a cushion member, no damage is applied to the golf club GS.

FIGS. 7A to 7D show a modified embodiment of the first embodiment.

Figure 7A:
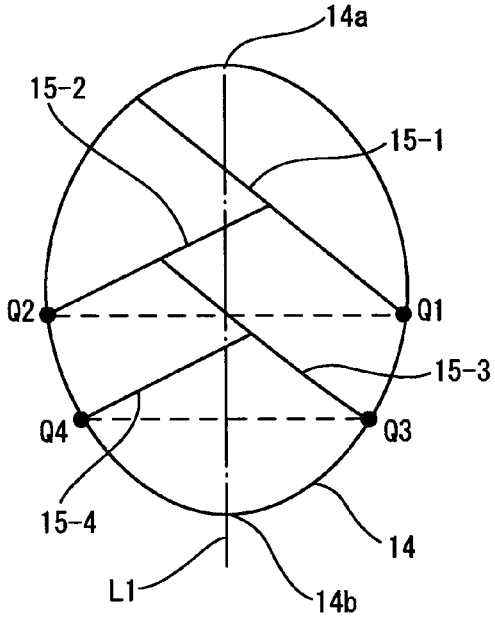
FIGS. 7A to 7D are schematic views showing a modified embodiment of the first embodiment.

FIG. 7A shows a structure provided with four division plates constituted by two right slope plates 15-1 and 15-3 and two left slope plates 15-2 and 15-4, and having four divided spaces. In addition, all of the slope plates are formed as a linear slope plate. A connection position Q1 between the outer end of the first right slope plate 15-1 and the opening frame 15 is positioned so as to oppose to a connection position Q2 between the outer end of the first left slope plate 15-2 and the opening frame 15, and a connection position Q3 between the second right slope plate 15-3 and the opening frame 15 is positioned so as to oppose to a connection position Q4 between the second left slope plate 15-4 and the opening frame 15, in the same manner. The other structures are the same as those of the first embodiment.

Figure 7B:
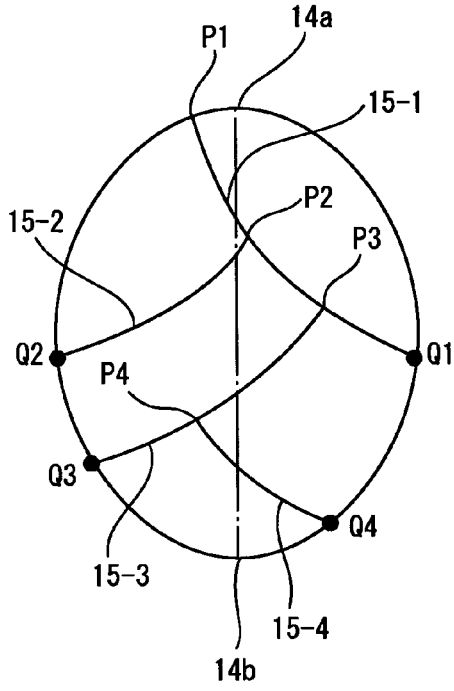

FIG. 7B shows a structure provided with four curved slope plates and having five divided spaces. The first left slope plate 15-1 and the second left slope plate 15-3 are connected to the first right slope plate 15-1 at an interval longitudinally, and the second right slope plate 15-4 is connected to the second left slope plate. The other structures are the same as those of the first embodiment.

Figure 7C:
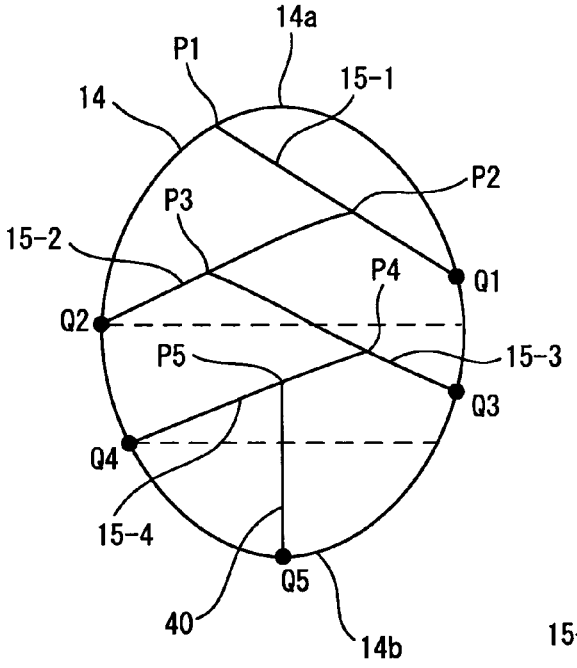

FIG. 7C shows a structure in which a longitudinal division plate 40 extending along a longitudinal center line L1 is mounted to a lower portion of the second left slope plate 15-4 in FIG. 7A.

Figure 7D:
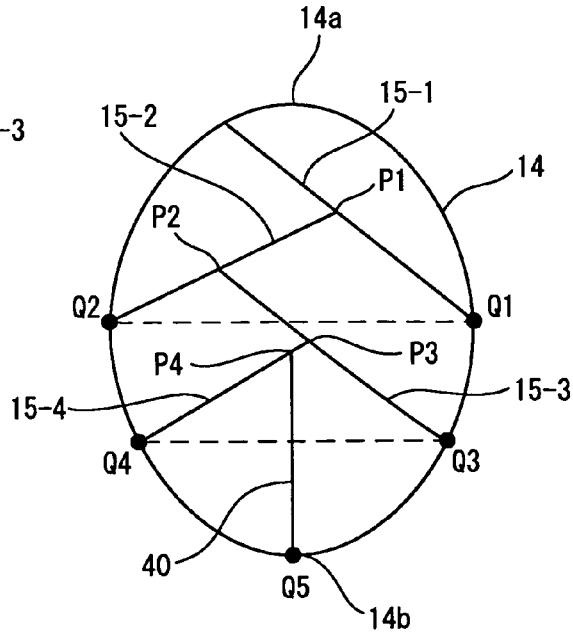

FIG. 7D shows a structure in which the connection positions Q1 to Q4 between the outer end edges of the right and left slope plates and the opening frame are shifted in a longitudinal direction in the same manner as that of the first embodiment, and the longitudinal division plate 40 extending along the longitudinal center line L1 is mounted to the lower portion of the second left slope plate 15-4 in the same manner as that shown in FIG. 7C, whereby the divided space forming a lowest end at a time when the caddie bag is inclined is divided into right and left sides.

The other structures in FIGS. 7C and 7D are the same as those of the first embodiment.

Figure 8A:
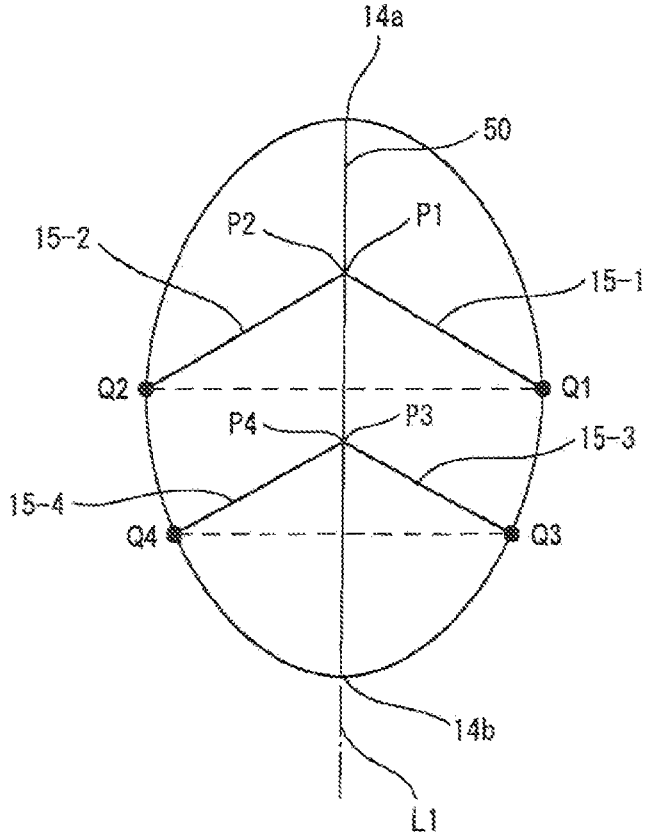
FIGS. 8A and 8B are schematic views showing a second embodiment.
Figure 8B:
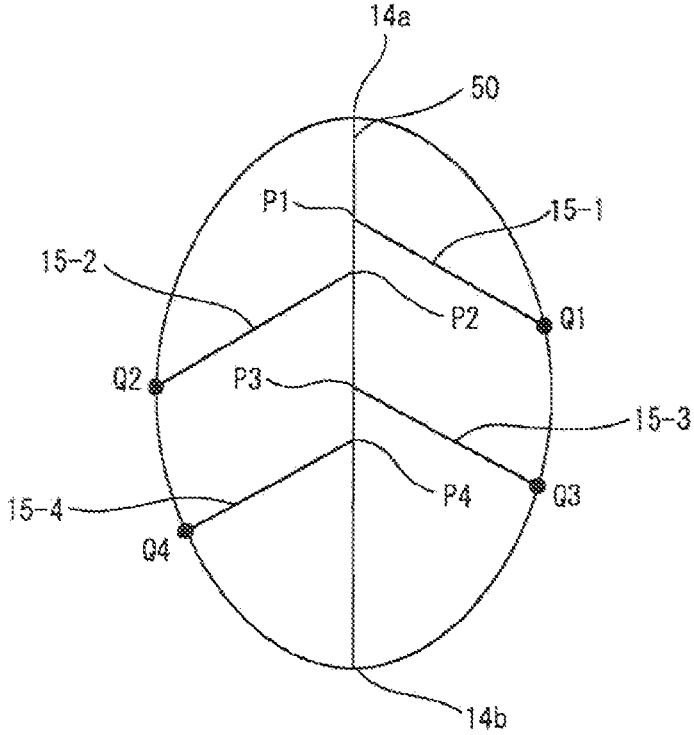

FIGS. 8A and 8B show a second embodiment which is a large-size caddie bag and is suitable in the case that the opening frame 14 has a large area.

In FIG. 8A, the structure is made such that a longitudinal center division plate 50 is provided along a longitudinal center line L1 connecting a front face side center and a back face side center of the opening frame 14, inner end edges of the first right slope plate 15-1 and the first left slope plate 15-2 are connected at points P1 and P2 in an opposing manner in both the right and left surfaces of the longitudinal center division plate 50, and inclined outer end edges are connected to the opening frame 14 at two points Q1 and Q2. Accordingly, three symmetrical divided spaces are provided in the right and left areas divided by the longitudinal center division plate 50, whereby the number of the divided spaces is set to six.

In FIG. 8B, the structure is made such that the right and left slope plates 15-1 to 15-4 are shifted in the longitudinal direction, the inner end connecting positions P1 to P4 connected to both the right and left surfaces of the longitudinal center division plate 50 are shifted, and the outer end connecting positions Q1 to Q4 are shifted in the longitudinal direction.

In the case of the second embodiment, since both the right and left sides of the respective divided spaces are inclined to the back face side in comparison with the center position, the golf clubs received in the respective divided spaces are dispersed to both the lower left and the lower right, and it is possible to prevent the golf clubs from getting together in the center and overlapping.

Figure 9:
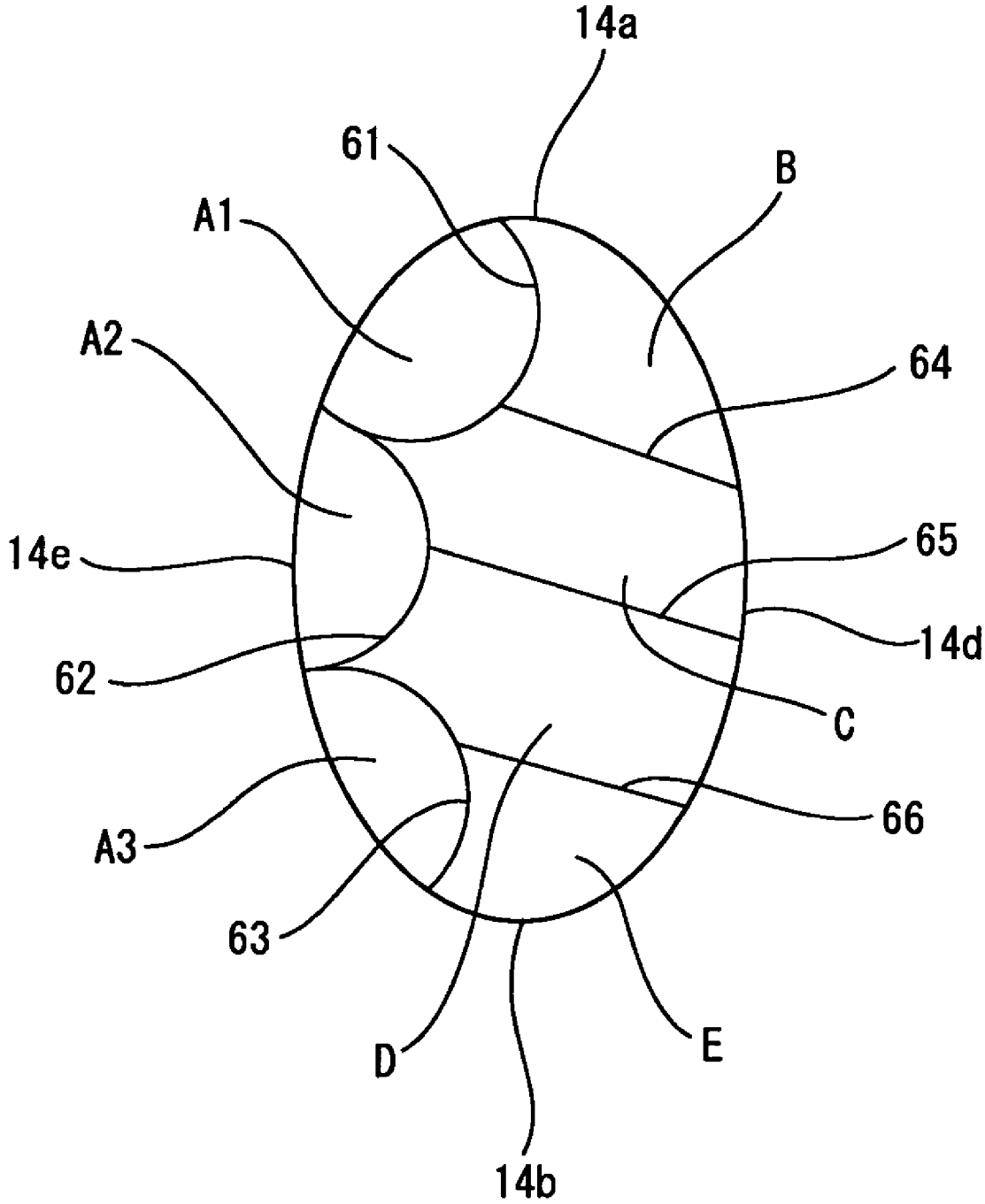
FIG. 9 is a schematic view showing a third embodiment.
Figure 10A:
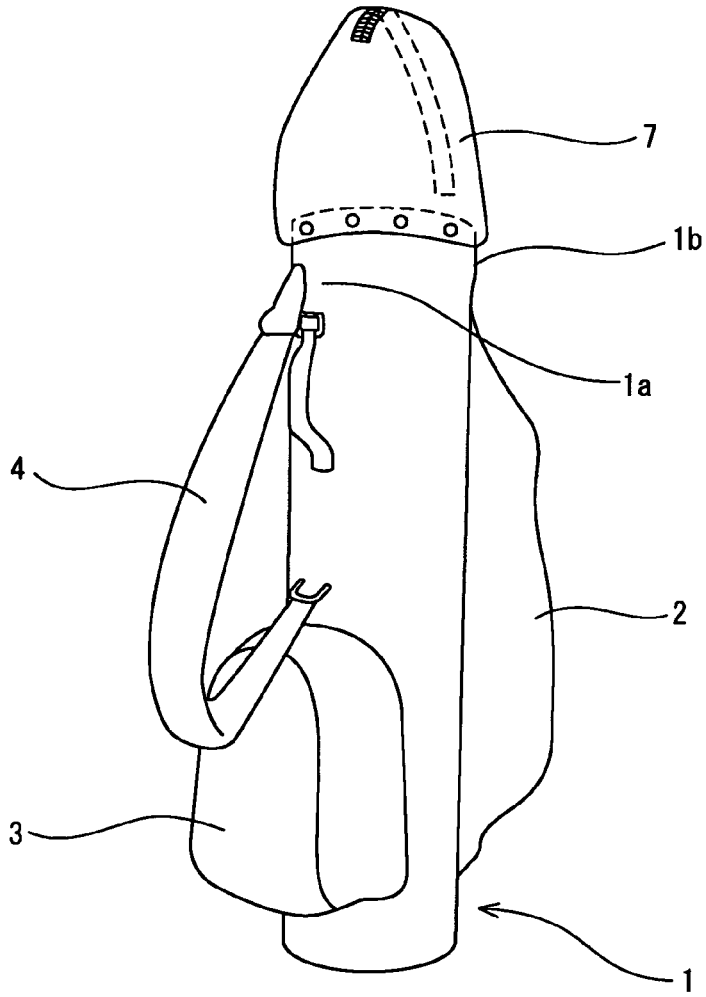
Figure 10B:
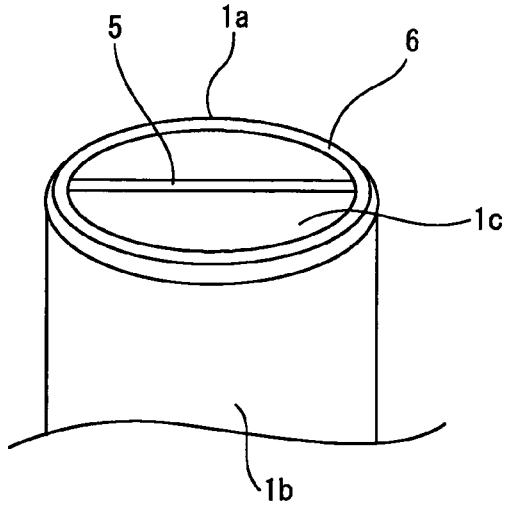
Figure 11A:
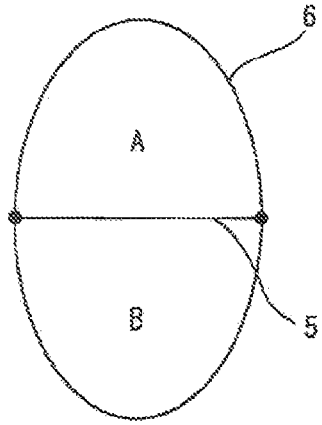
FIGS. 11A to 11D are schematic views showing an arrangement example of the conventional division plate.
Figure 11B:
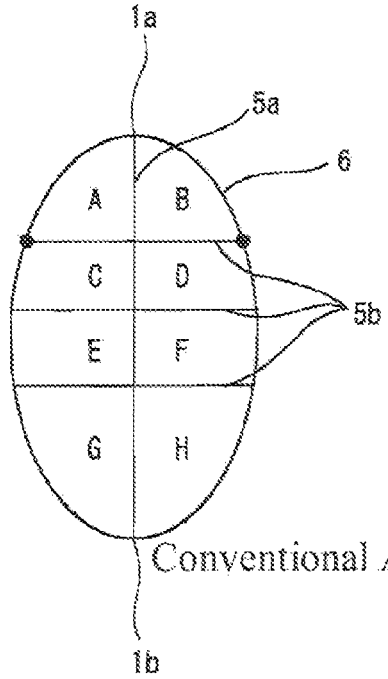
Conventional Art Fig. 11B
Figure 11C:
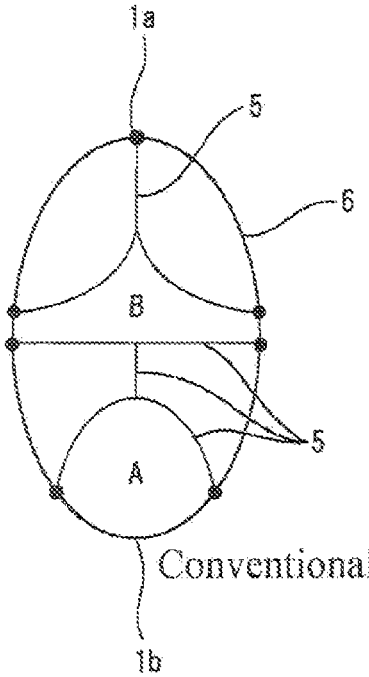
Conventional Art Fig. 11C
Figure 11D:
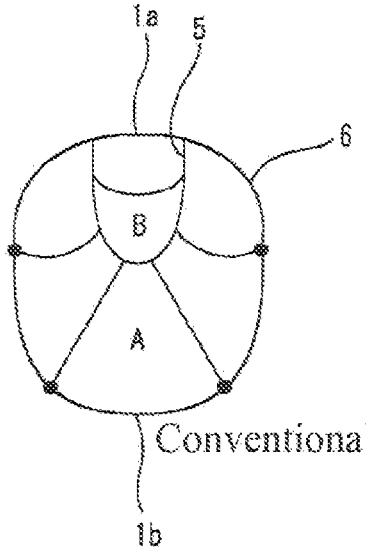
Conventional Art Fig. 11D
Figure 12A:
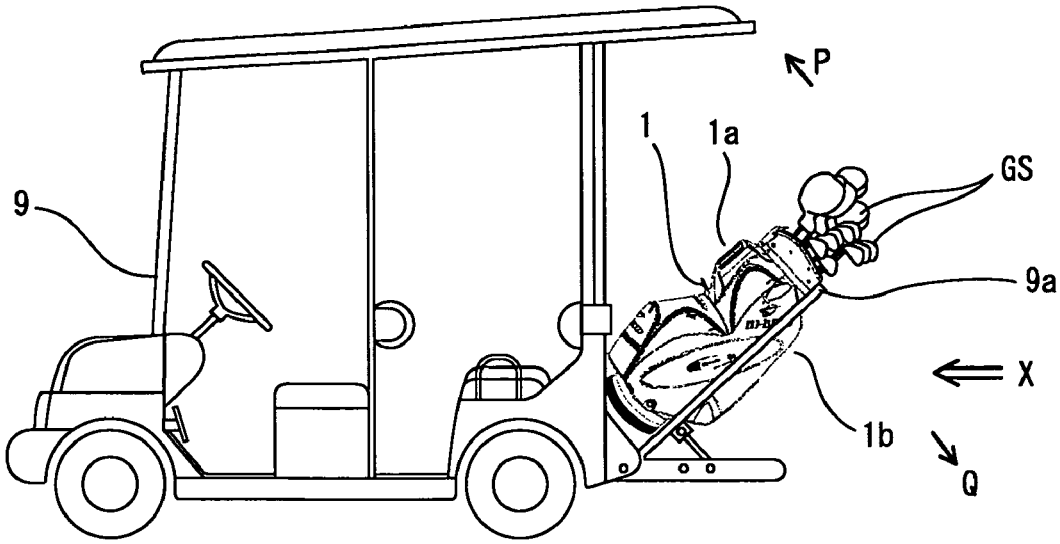
FIG. 12A is a view showing a state in which the caddie bag is mounted on the cart.
Figure 12B:
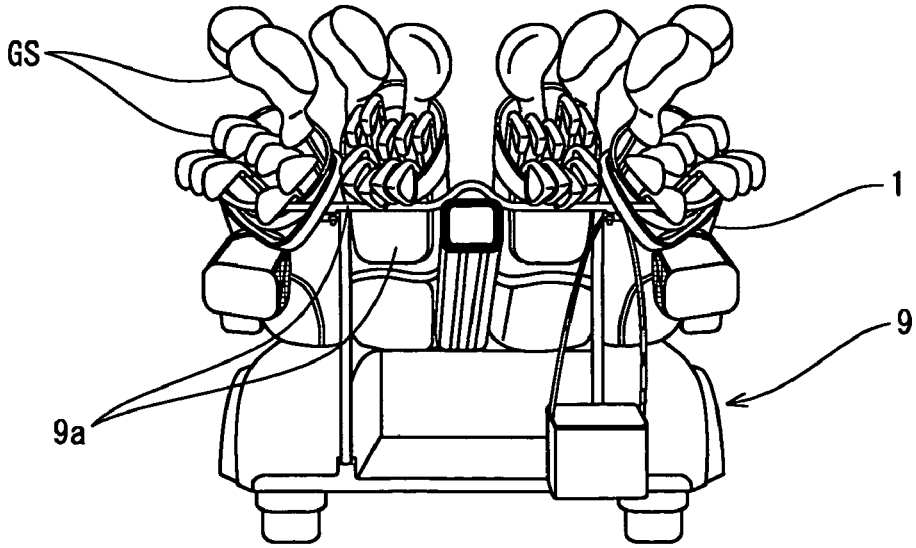
FIG. 12B is a view as seen from an arrow X in FIG. 12A.

FIG. 9 shows a third embodiment, in which three circular arc division plates 61, 62 and 63 are mounted to a left frame 14*e* of the opening frame 14 in a state in which both ends thereof are connected. Three right slope plates 64, 65 and 66 are mounted so as to be inclined from respective apex positions to a back face side 14*b* (to the lower right) toward a right frame 14*d* of the opening frame 14.

Three small divided spaces A1 to A3 surrounded by the respective circular arc division plates 61 to 63 and the opening frame 14 are formed respectively as the receiving positions for the wood type golf clubs. Since respective divided spaces B to E divided by the right slope plates 64 to 66 are inclined to the back face side in the same manner as the first and second embodiments, the spaces move the golf clubs received in the divided spaces B to E so as to prevent the golf clubs from getting together in the center portion.

Since the other structures are the same as those of the first embodiment, a description thereof will be omitted.

In this case, in order to sufficiently achieve the effects of the invention, it is preferable that the following relation is established. On the assumption that the number of the right slope plates is set to m, the number of the left slope plates is set to n and the number of all the division plates is set to p, a value $p-(m+n)$ is not more than 2, more preferably not more than 1. Particularly, it is preferable that the relation $p=(m+n)$ is established. Further, it is preferable that a difference between m and n is set to be not more than 2, and further not more than 1. In this case, as shown in FIG. 8, even in the case that the longitudinal division plates dividing the right and left divided spaces arranged along the longitudinal center line are connected in the longitudinal direction in shape, the longitudinal division plates are numbered as the independent longitudinal division plates without taking the connection in the longitudinal direction in shape into consideration. For example, in the case of FIG. 8, the number of the longitudinal division plates is considered as three.

Further, in order to sufficiently achieve the effects of the invention, it is preferable that the following relation is established. On the assumption that the number of the left divided spaces extending over the longitudinal center line (the center line connecting the center position in the lateral width direction in the front face side to the center position in the lateral direction in the back face side) from the left end is set to q, and the number of the right divided spaces extending over the longitudinal center line from the right end is set to r, and the number of all the divided spaces is set to s, a value s−(q+r) is not more than 2, more preferably not more than 1. Particularly, it is preferable that the relation s=(q+r) is established. Further, it is preferable that a difference between q and r is set to be not more than 2, and further not more than 1. In this case, in the provision of the number, the divided space closest to the back face side existing astride the longitudinal center line as shown by the space F in FIG. 3 is counted as it is neither the left divided space nor the right divided space. In specific, it is preferable that the relation s−(q+r)=1 is set, and the divided space closest to the back face side existing astride the longitudinal center line is set to only one, as the other divided space than the left divided space and the right divided space.

What is claimed is:

1. A caddie bag comprising:

a bag body having an upper end opening;

an opening frame fitted within the upper end opening, the opening frame having a front side, a back side, a left side and a fight side;

a plurality of division plates provided within the opening frame and dividing the opening frame into sectioned spaces; wherein the division plates include (1) right slope plates which are inclined toward the right side in a direction from the front side toward the back side and (2) left slope plates which are inclined toward the left side in a direction from the front side toward the back side;

outer ends of the right and left slope plates are connected, respectively, to right and left sides of the opening frame, inner ends of one or more of the right and left slope plates are connected, respectively, to left and right slope plates at positions within the opening frame;

at least one of the positions is shifted in a direction toward a right or left side of the opening frame away from a longitudinal center line extending between a center of the of the front side and a center of the back side of the opening frame, whereby at least one of the sectioned spaces extends over the longitudinal center line; and each of the sectioned spaces is inclined away from a center region of the opening frame and toward the fight side or the left side of the opening frame in a direction from the front side toward the back side.

2. The caddie bag according to claim 1, wherein a shoulder belt is provided in an outer surface of an upper portion in a front face side of said body.

3. The caddie bag according to claim 2, wherein an area of each of the sectioned spaces divided by the division plates within the opening frame is enlarged step by step toward both the right and left sides from the center region.

4. The caddie bag according to claim 2, wherein slope angles of said right slope plate and said left slope plate are set such that a slope angle α with respect to a lateral straight line orthogonal to the longitudinal center line connecting the front side center to the back side center is not less than 5 degree and not more than 45 degree.

5. The caddie bag according to claim 1, wherein an area of each of the sectioned spaces divided by the division plates within the opening frame is enlarged step by step toward both the right and left sides from the center region.

6. The caddie bag according to claim 1, wherein slope angles of said right slope plate and said left slope plate are set such that a slope angle α with respect to a lateral straight line orthogonal to the longitudinal center line connecting the front side center to the back side center is not less than 5 degree and not more than 45 degree.

7. The caddie bag according to claim 1, wherein the number of said division plates is set to a range between three and seven, and the number of the spaces divided by the division plates is four to eight.

8. The caddie bag according to claim 1, wherein said opening frame is formed in an oval shape or an elliptic shape in which the longitudinal center line connecting the front side center and the back side center is a long axis, and a lateral center line connecting the right and left centers is a short axis.

9. The caddie bag according to claim 1, wherein said opening frame is formed in a chevron shape when viewed from the left side or the right side, an upper end of a center in the front side is located above an upper end of a center in the back side when the bag is upright, and a distance from the front side center to a chevron apex is made shorter than a distance from said chevron apex to the back side center.

10. The caddie bag according to claim 1, wherein said opening frame and upper portions of the right and left slope plates are formed by a rigid member, and lower portions of said fight and left slope plates are formed by an elastic member.

11. A caddie bag comprising:

a bag body having an upper end opening;

an opening frame fitted within the upper end opening, the opening frame having a front side, a back side, a left side and a right side;

a plurality of division plates provided within the opening frame and dividing the opening frame into sectioned spaces; wherein the division plates consist only of (1) right slope plates which are inclined toward the right side in a direction from the front side toward the back side and (2) left slope plates which are inclined toward the left side in a direction from the front side toward the back side;

outer ends of the right and left slope plates are connected, respectively, to right and left sides of the opening frame; and each of the sectioned spaces is inclined away from a center region of the opening frame and toward the right side or the left side of the opening frame in a direction from the front side toward the back side.

12. A caddie bag comprising:

a bag body having an upper end opening;

an opening frame fitted within the upper end opening, the opening frame having a front side, a back side, a left side and a right side;

a plurality of division plates provided within the opening frame and dividing the opening frame into sectioned spaces; wherein the division plates include (1) right slope plates which are inclined toward the right side in a direction from the front side toward the back side and (2) left slope plates which are inclined toward the left side in a direction from the front side toward the back side;

both ends of(1) one of the right slope plates or (2) one of the left slope plates are connected to the opening frame;

outer ends of others of the right and left slope plates are connected, respectively, to right and left sides of the opening frame;

inner ends of others of the right and left slope plates are connected, respectively, to front sides of left and right slope plates at intermediate positions thereof; and each of the sectioned spaces is inclined away from a center region of the opening frame and toward the right side or the left side of the opening frame in a direction from the front side toward the back side.

13. A caddie bag comprising:

a bag body having an upper end opening;

an opening frame fitted within the upper end opening, the opening frame having a front side, a back side, a left side and a right side;

a plurality of division plates provided within the opening frame and dividing the opening frame into sectioned spaces; wherein the division plates include (1) right slope plates which are inclined toward the right side in a direction from the front side toward the back side and (2) left slope plates which are inclined toward the left side in a direction from the front side toward the back side;

outer ends of the right and left slope plates are connected, respectively, to right and left sides of the opening frame; and inner ends of the right slope plates are connected to left slope plates at positions within the opening frame;

the positions are displaced toward the left side of a longitudinal center line extending between a center of the front side and a center of the back side of the opening frame, whereby the sectioned spaces at the front sides of the right slope plates extend from a left side of the longitudinal center line to the right side of the opening frame; and each of the sectioned spaces is inclined away from a center region of the opening frame and toward the right side or the left side of the opening frame in a direction from the front side toward the back side.

14. A caddie bag comprising:

a bag body having an upper end opening;

an opening frame fitted within the upper end opening, the opening frame having a front side, a back side, a left side and a right side;

a plurality of division plates provided within the opening frame and dividing the opening frame into sectioned spaces; wherein the division plates include (1) right slope plates which are inclined toward the right side in a direction from the front side toward the back side and (2) left slope plates which are inclined toward the left side in a direction from the front side toward the back side;

outer ends of the right and left slope plates are connected, respectively, to right and left sides of the opening frame; and inner ends of the left slope plates are connected to right slope plates at positions within the opening frame;

the positions are displaced toward the right side of a longitudinal center line extending between a center of the front side and a center of the back side of the opening frame, whereby the sectioned spaces at the front sides of the left slope plates extend from a right side of the longitudinal center line to the left side of the opening frame; and each of the sectioned spaces is inclined away from a center region of the opening frame and toward the right side or the left side of the opening frame in a direction from the front side toward the back side.

* * * * *